US008270646B2

(12) United States Patent
Heerlein et al.

(10) Patent No.: US 8,270,646 B2
(45) Date of Patent: Sep. 18, 2012

(54) HEARING AID DEVICE WITH AN ON/OFF SWITCH

(75) Inventors: Markus Heerlein, Singapore (SG); Wai Kit Ho, Singapore (SG); Kah Hooi Vincent Ong, Singapore (SG)

(73) Assignee: Siemens Medical Instruments Ptd. Ltd., Singapore (SG)

( * ) Notice: Subject to any disclaimer, the term of this patent is extended or adjusted under 35 U.S.C. 154(b) by 1059 days.

(21) Appl. No.: 11/922,610

(22) PCT Filed: Jun. 25, 2005

(86) PCT No.: PCT/SG2005/000212

§ 371 (c)(1),
(2), (4) Date: Dec. 20, 2007

(87) PCT Pub. No.: WO2007/001234

PCT Pub. Date: Jan. 4, 2007

(65) Prior Publication Data

US 2009/0136069 A1 May 28, 2009

(51) Int. Cl.
*H04R 25/00* (2006.01)

(52) U.S. Cl. ..... 381/323; 381/322; 381/324

(58) Field of Classification Search ..... 381/323
See application file for complete search history.

(56) References Cited

U.S. PATENT DOCUMENTS

| | | | | |
|---|---|---|---|---|
| 3,828,142 | A * | 8/1974 | Buttner | 381/323 |
| 4,550,227 | A | 10/1985 | Topholm | |
| 5,347,584 | A * | 9/1994 | Narisawa | 381/323 |
| 5,386,476 | A | 1/1995 | Bisgaard et al. | |
| 5,588,064 | A | 12/1996 | McSwiggen et al. | |
| 5,712,919 | A * | 1/1998 | Ruhling | 381/316 |
| 5,799,095 | A * | 8/1998 | Hanright | 381/312 |
| 2003/0185413 | A1 | 10/2003 | Schmitt | |
| 2005/0232453 | A1* | 10/2005 | Fideler | 381/322 |
| 2006/0126875 | A1* | 6/2006 | Kragelund | 381/327 |

FOREIGN PATENT DOCUMENTS

| | | | |
|---|---|---|---|
| DE | 29916350 | U1 | 2/2000 |
| EP | 0388501 | A1 | 9/1990 |

* cited by examiner

*Primary Examiner* — David Warren
*Assistant Examiner* — Christopher Uhlir

(57) ABSTRACT

The invention relates to a hearing aid device and a hearing aid switch. The switch is operable to open and close an electric circuit of the hearing aid device. A lock for the switch is operable to selectively enable and disenable a hearing aid device function. The hearing aid device comprises a device for selectively inhibiting the operation of the switch to enable or to disenable the hearing aid device function.

12 Claims, 22 Drawing Sheets

HEARING AID DEVICE WITH AN ON/OFF SWITCH

CROSS REFERENCE TO RELATED APPLICATIONS

This application is the US National Stage of International Application No. PCT/SG2005/000212, filed Jun. 25, 2005 and claims the benefit thereof.

TECHNICAL FIELD OF THE INVENTION

The present invention relates to a hearing aid device. The present invention also relates to a hearing aid switch arrangement for use in a hearing aid device having an electric circuit.

BACKGROUND OF THE INVENTION

Behind-the-ear (BTE) and in-the-ear (ITE) hearing aids typically include operational features such as on/off control, volume control and noise filtration control.

The on/off control feature, for example, has previously been effected by physically connecting and disconnecting a battery to the electric circuit of the hearing aid. A battery compartment door of the hearing aid is typically used to secure the battery inside the hearing aid. When closed, the battery compartment door locates the terminals of the battery in position for electrical communication with the electric circuit, thereby turning the device on. Conversely, the battery compartment door physically remove the battery from the body of the hearing aid, thereby breaking the electrical connection to the circuit, when the door is opened. Otherwise, opening the battery compartment door may simply expose the battery for removal from the device. It may not always be convenient to close and open the battery compartment doors of a hearing aid to switch the device on and off.

A disadvantage of switching off the hearing aid device in the above-described manner is that the battery is exposed to the elements and may deteriorate faster than it would have done so if it was located within the device. In addition, there is a risk that the battery may be dislodged from the device and lost.

Hearing aid devices that include an on/off switch may be inadvertently switched on or off. A person's hearing may be temporarily impaired if the device is accidentally turned off during use. Further, the battery may be unnecessarily depleted if the hearing aid is left on during a period of non-use.

It is generally desirable to overcome or ameliorate one or more of the above mentioned difficulties, or at least provide a useful alternative.

SUMMARY OF THE INVENTION

In accordance with one aspect of the present invention, there is provided a hearing aid device, including:

(a) a switch being operable to open and close an electric circuit of the device;

(b) a battery locating means for selectively locating a battery within said device for electrical communication with said electric circuit; and (c) means for selectively inhibiting operation of the switch to open the electric circuit, wherein the battery locating means inhibits the removal of the battery from electrical communication with said electric circuit when the switch is arranged to close the electric circuit.

Preferably, the battery locating means permits access to the battery for removal of the battery from the device when the switch is arranged to open the electric circuit.

Preferably, the battery locating means is adapted to move the battery with respect the electric circuit to thereby connect and isolate the battery to and from the electric circuit.

In accordance with another aspect of the present invention, there is provided a hearing aid switch arrangement for use in a hearing aid device having an electric circuit, the hearing aid switch arrangement including:

(a) an activation switch being operable to open and close the electric circuit of the device;

(b) a battery locating means for selectively locating a battery within said device for electrical communication with said electric circuit; and (c) means for selectively inhibiting operation of the switch to open the electric circuit, wherein the battery locating means inhibits the removal of the battery from electrical communication with said electric circuit when the switch is arranged to close the electric circuit.

Preferably, the battery locating means permits access to the battery for removal of the battery from the device when the switch is arranged to open the electric circuit.

Preferably, the battery locating means is adapted to move the battery with respect the electric circuit to thereby connect and isolate the battery to and from the electric circuit.

In accordance with yet another aspect of the present invention, there is provided a lock for a switch of a hearing aid device, said switch being operable to selectively enable or to selectively disenable a hearing aid device function, including means for selectively inhibiting operation of the switch to enable or to disenable the hearing aid device function.

In accordance with yet another aspect of the present invention, there is provided, in combination, a lock and a switch for a hearing aid device, said switch being operable to selectively enable or to selectively disenable a hearing aid device function and said lock being adapted to selectively inhibit operation of the switch to enable or to disenable the hearing aid device function.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
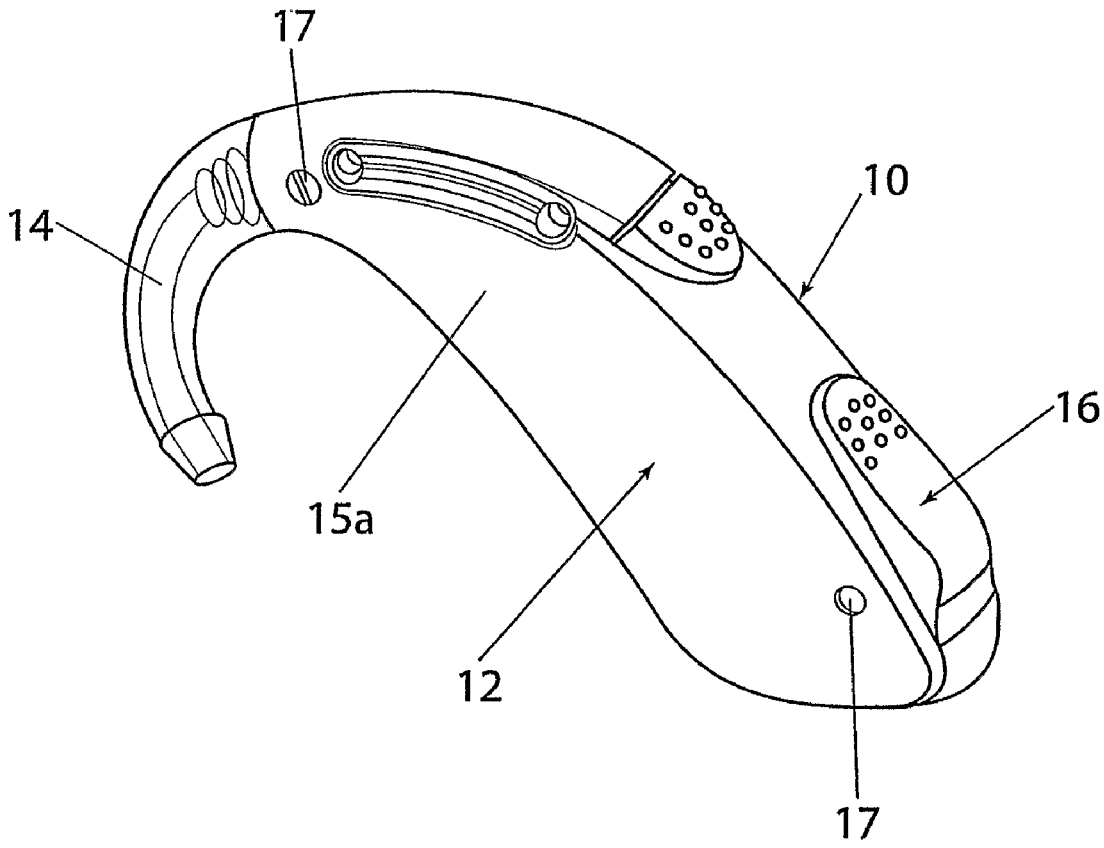
FIG. 1 is a perspective view of a hearing aid device in accordance with a preferred embodiment of the invention.

The behind-the-ear (BTE) hearing aid device 10 shown in FIG. 1 includes a housing 12 coupled to a hook 14. The housing 12 is formed in two shells 15*a*,15*b* (only 15*a* shown in FIG. 1) that are fastened together by screws 17. The housing 12 is shaped to fit behind the ear of a person and encases many of the internal components of the hearing aid 12. The hook 14 is coupled to an end of the housing 12 and is shaped to extend into the ear of a person wearing the device 10. Preferred embodiments of the invention are hereafter described by way of reference to the BTE hearing aid 10. However, it would be understood by those skilled in the relevant art that the invention is applicable to any one of a number of different types of hearing aid devices.

The hearing aid device 10 includes a switch 16 that is used to turn the hearing aid 10 on and off. The switch 16 includes an on/off cover 18 mechanically coupled to a battery compartment door 20 in the manner shown in FIGS. 2 to 4. The on/off cover 18 is rotatable about an axle 26 so as to move between on and off positions that respectively complete and break, ie close and open, an electric circuit 22. The battery compartment door 20 is coupled to the housing 12 by a hinge that facilitates movement of the door 20 between open and closed positions with respect to the housing 12. The door 20 includes a cradle 23 that is shaped to receive a battery 24. The battery 24 can be loaded into, or removed from, the cradle 23 when the door 20 has been opened. The cradle 23 locates the battery within the housing 12 for electrical connection with the electric circuit 22 when the door 20 is closed. The mechanical connection between the on/off cover 18 and the battery compartment door 20 prevents the door 20 from being opened when the on/off cover 18 is arranged in the on position. The on/off cover 18 thereby prevents the battery 24 from being removed from the device 10 when the cover 18 is arranged in the on position.

Figure 5:
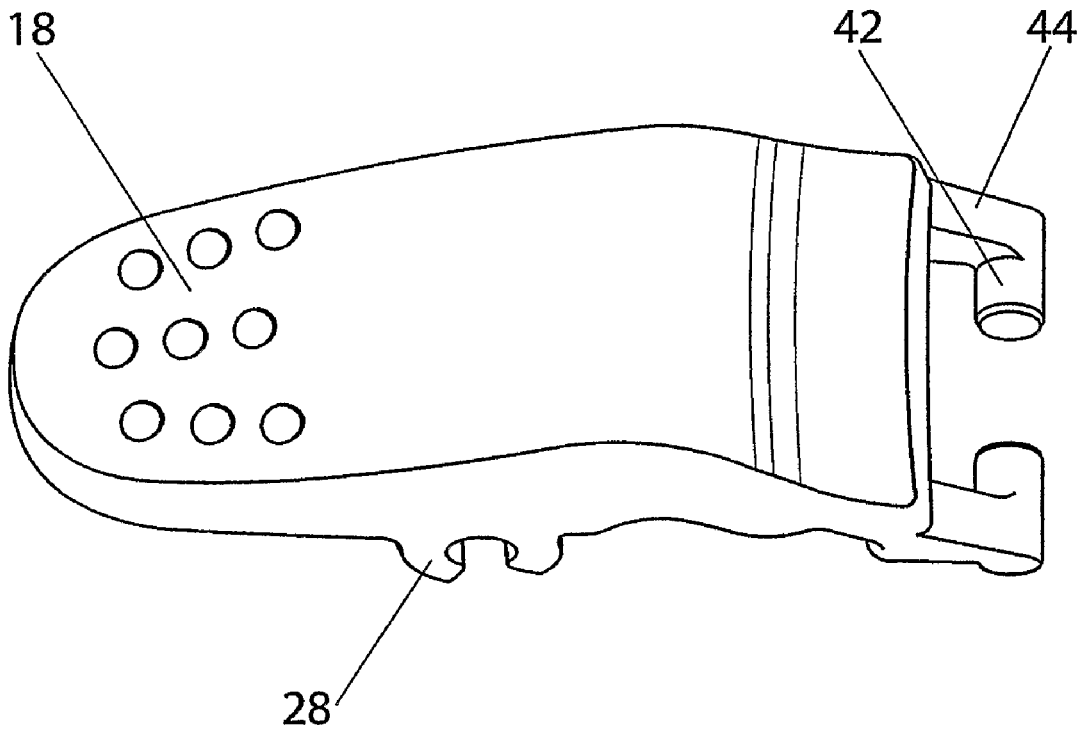
FIG. 5 is a perspective view of a part of the hearing aid shown in FIG. 1.

The on/off cover 18, also shown in FIG. 5, is removably attached to the housing 12 by way of the axle 26. The axle 26 bridges a gap between opposed internal sidewalls of the two shells 15*a*,15*b* of the housing 12. The opposed internal sidewalls include recesses shaped to receive respective ends of the axle 26 and thereby hold the axle 26 in position. The on/off cover 18 is coupled to, and is adapted to rotate about an axle 26 by way of a clasp 28. The clasp 28 permits the on/off cover to be removably attached to the axle 26. The clasp 28 is made of a resilient material, such as Acrylonitrile Butadiene Styrene (ABS), that permits the clasp 28 to snapped onto the axle 26 with the application of a suitable force.

Figure 6:
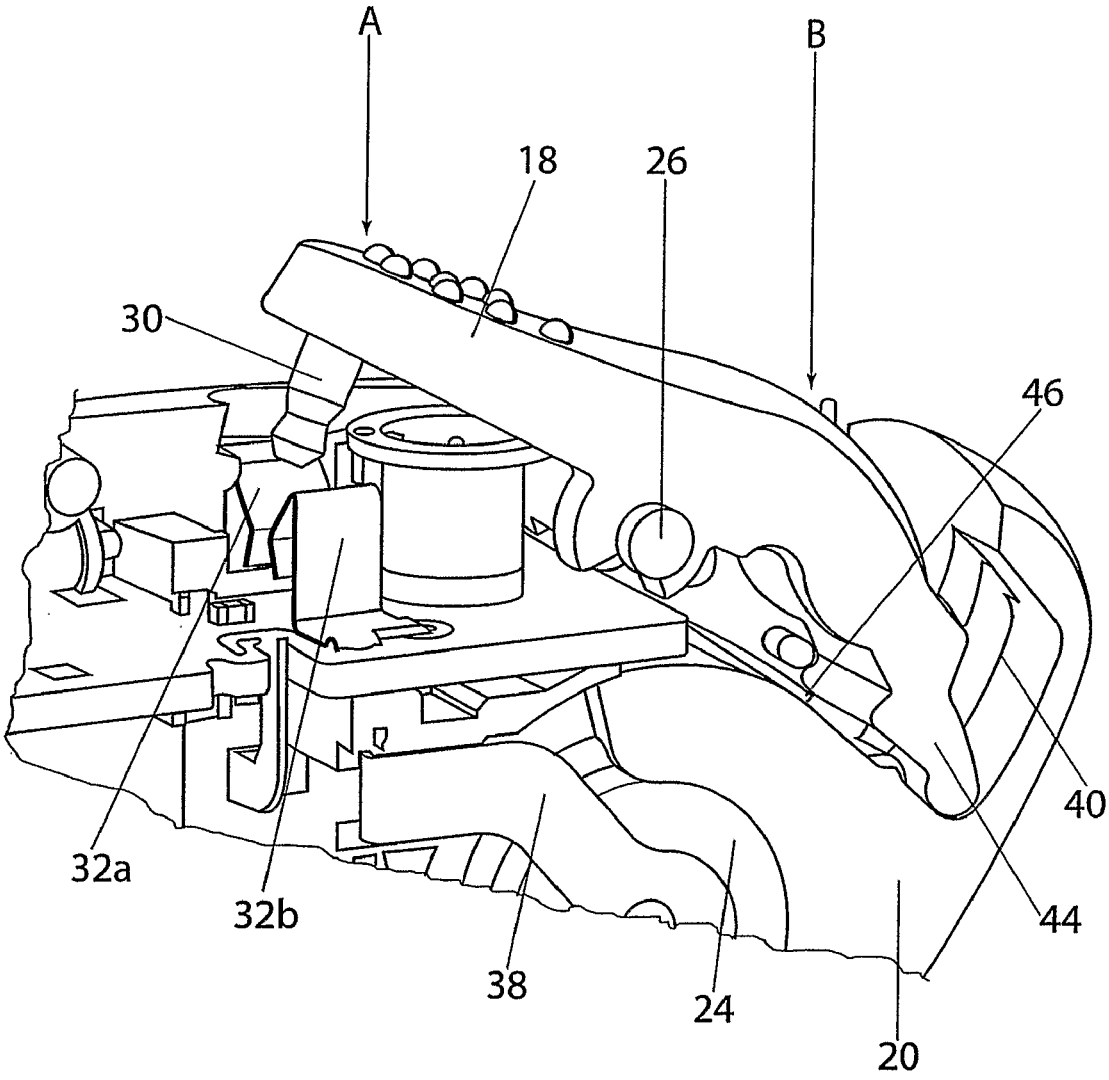
FIG. 6 is a view of yet another section of the hearing aid device shown in FIG. 1 with part of the housing removed so as to show the internal parts of the device.
Figure 7:
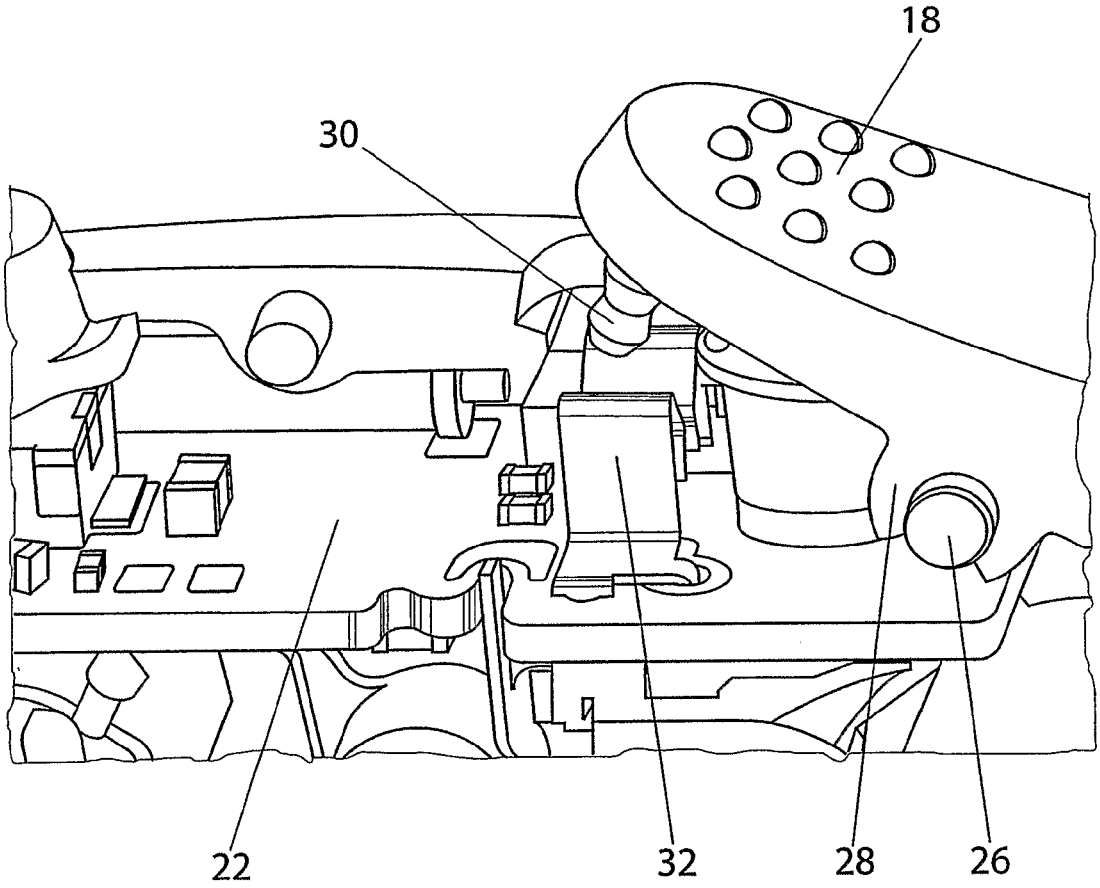
FIG. 7 is a view of another section of the hearing aid device shown in FIG. 1 with part of the housing removed so as to show the internal parts of the device.

The switch 16 includes male and female electrically conductive contact elements 30,32 secured to the on/off cover 18 and the electric circuit 22 respectively in the manner shown in FIGS. 6 and 7. The female contact element 32 includes first and second parallel, spaced apart, resilient conductive lugs 32*a*,32*b* that project outwardly from the electric circuit 22. Distal ends of the contacts 32*a*,32*b* include opposed flanges that each extend towards the other lug 32*a*,32*b*. The flanges are spaced apart and define a socket that is shaped to receive the male contact element 30.

When a force is applied to the on/off cover in direction B, the on/off cover 18 rotates about the axle 26 and the male contact element 30 moves away from the female contact element 32. In doing so, the lugs 32*a*,32*b* of the female contact element 32 are electrically isolated and the electric circuit 22 is switched off. When so arranged the on/off cover 18 is in the off position. When a force is applied to the on/off cover 18 in direction A, the on/off cover 18 rotates about the axle 26 and the male contact element 30 moves towards the female contact element 32. In doing so the male contact element 30 is located between the resilient lugs 32*a*,32*b* and bears against the respective flanges. The flanges resiliently deform and engage the male contact element 30. The flanges interlock with corresponding waisted sections of the male contact element 30 and thereby secure the on/off cover 18 in the on position. Alternatively, the flanges secure the male contact element therebetween by any other suitable means. The male contact element 30 thereby closes the circuit 22.

Figure 8:
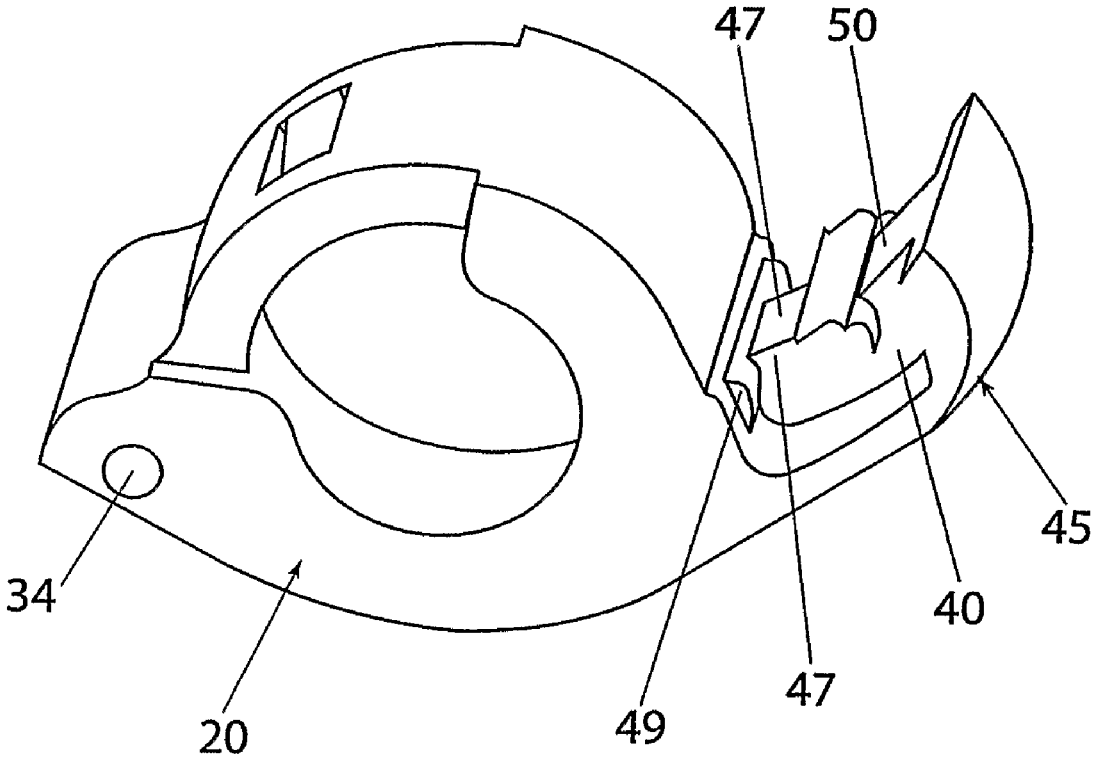
FIG. 8 is a perspective view of another part of the hearing aid shown in FIG. 1.
Figure 9:
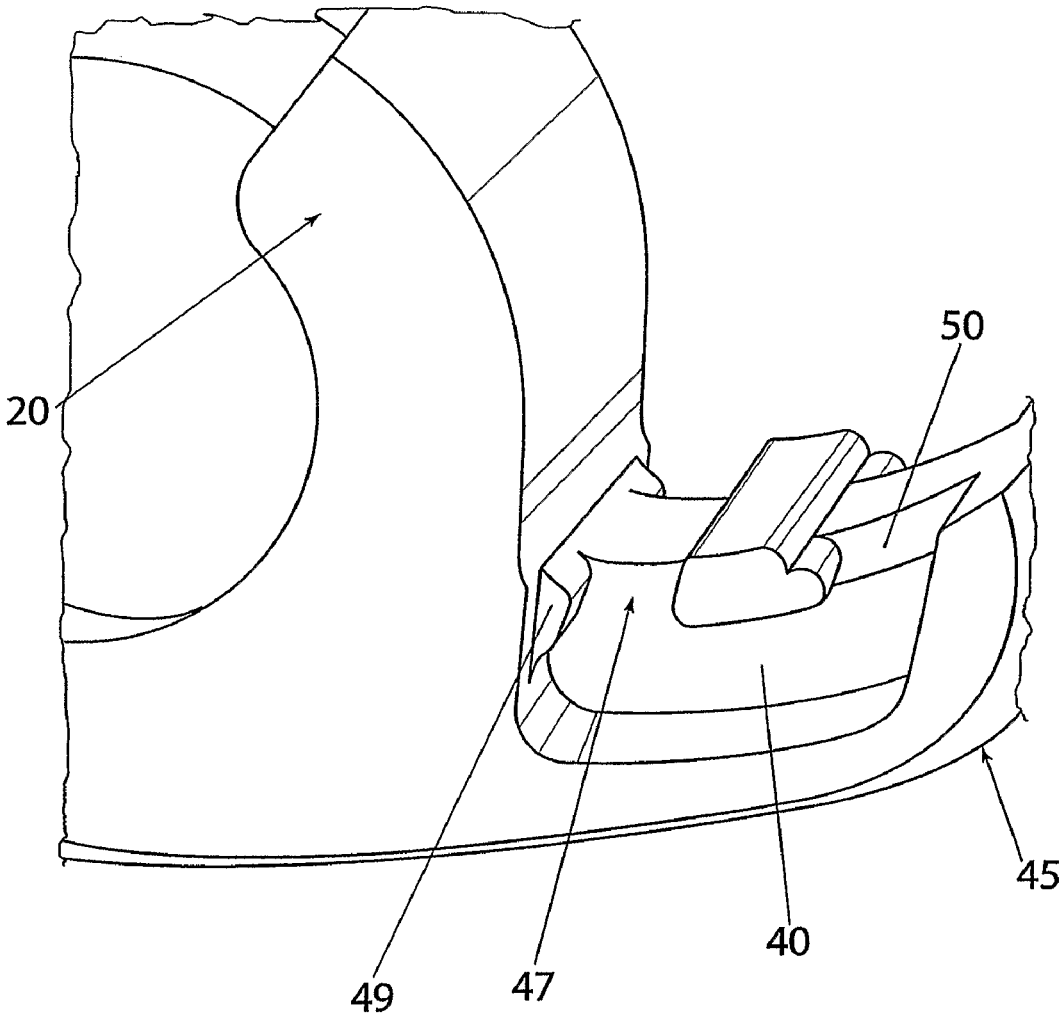
FIG. 9 is another perspective view of a part of the hearing aid device shown in FIG. 8.

The battery compartment door 20, also shown in FIGS. 8 and 9, includes a hole 34 that is shaped to receive the axle 25. The axle 25 is thereby removably and rotatably couplable to the door 20 of the housing 12. As above described, the battery compartment door 20 includes a cradle 23 that is shaped to receive the battery 24 and the door 20 locates the battery 24 in position for electrical connection to the electric circuit 22 when the door 20 is closed. The electric circuit 22 includes first and second electrically conductive contacts 38 (only one of which is shown in the drawings) that are arranged to engage respective oppositely charged terminals of the battery 24. The battery is electrically coupled to the circuit 22 when the door 20 is closed. The battery compartment door 20 removes the battery 24 from electrical communication with the electric circuit 22 when the door 20 is opened.

As also above described, the on/off cover 18 and the battery compartment door 20 are mechanically coupled together such that the battery compartment door 20 cannot be readily opened unless the on/off cover 18 is first arranged in the off position. The battery compartment door 20 includes first and second grooves 40 (only one of which is shown in the drawings) located on opposite sides of the door 20 for receiving corresponding pins 42 of the on/off cover 18. The pins 42 extend inwardly from respective distal ends of arms 44 that extend from opposite sides of a common end of the on/off cover 18. A locking section 45 of the door 20 is arranged between the arms 44. The arms 44 straddle the locking section 45 and locate the inwardly extending pins 42 in the respective corresponding grooves 40 of the locking section 45.

Figure 2:
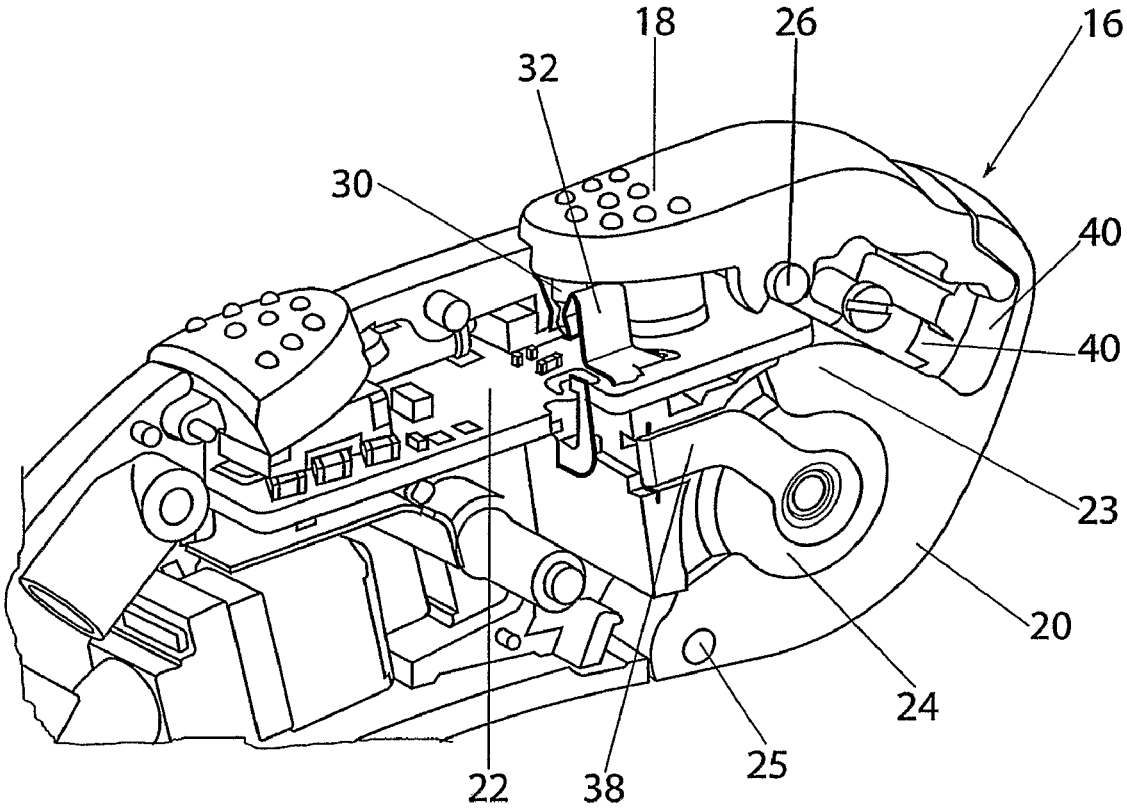
FIG. 2 is a view of a section of the hearing aid device shown in FIG. 1 with part of the housing removed so as to show the internal parts of the device.
Figure 3:
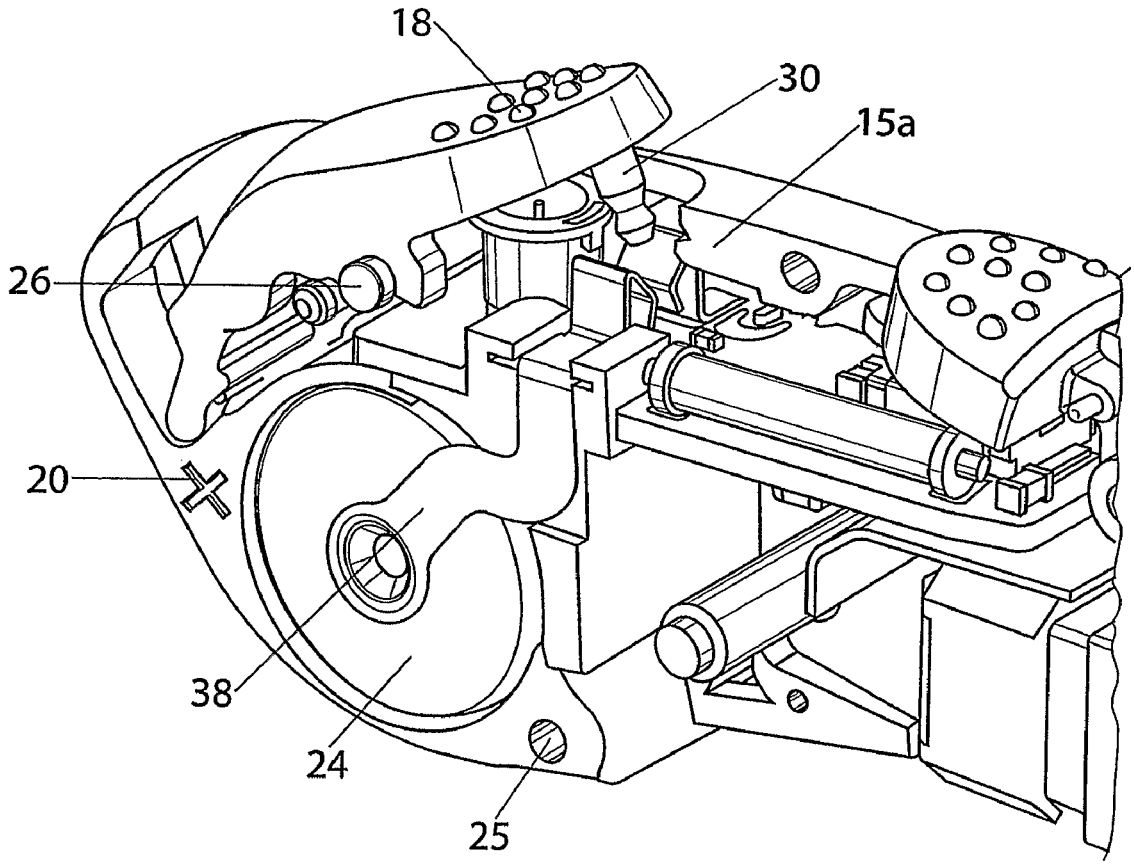
FIG. 3 is a view of another section of the hearing aid device shown in FIG. 1 with part of the housing removed so as to show the internal parts of the device.

The pins 42 slidably engage the grooves 40 such that when a force is applied to the on/off cover 18 in direction B, the on/off cover 18 rotates about the axle 26 and the pins 42 slide along the grooves 40, as shown in FIG. 6. Similarly, when a force is applied to the on/off cover 18 in direction A, the on/off cover 18 rotates about the axle 26 and the pins 42 slide along the groove 40, as shown in FIG. 2.

Figure 4:
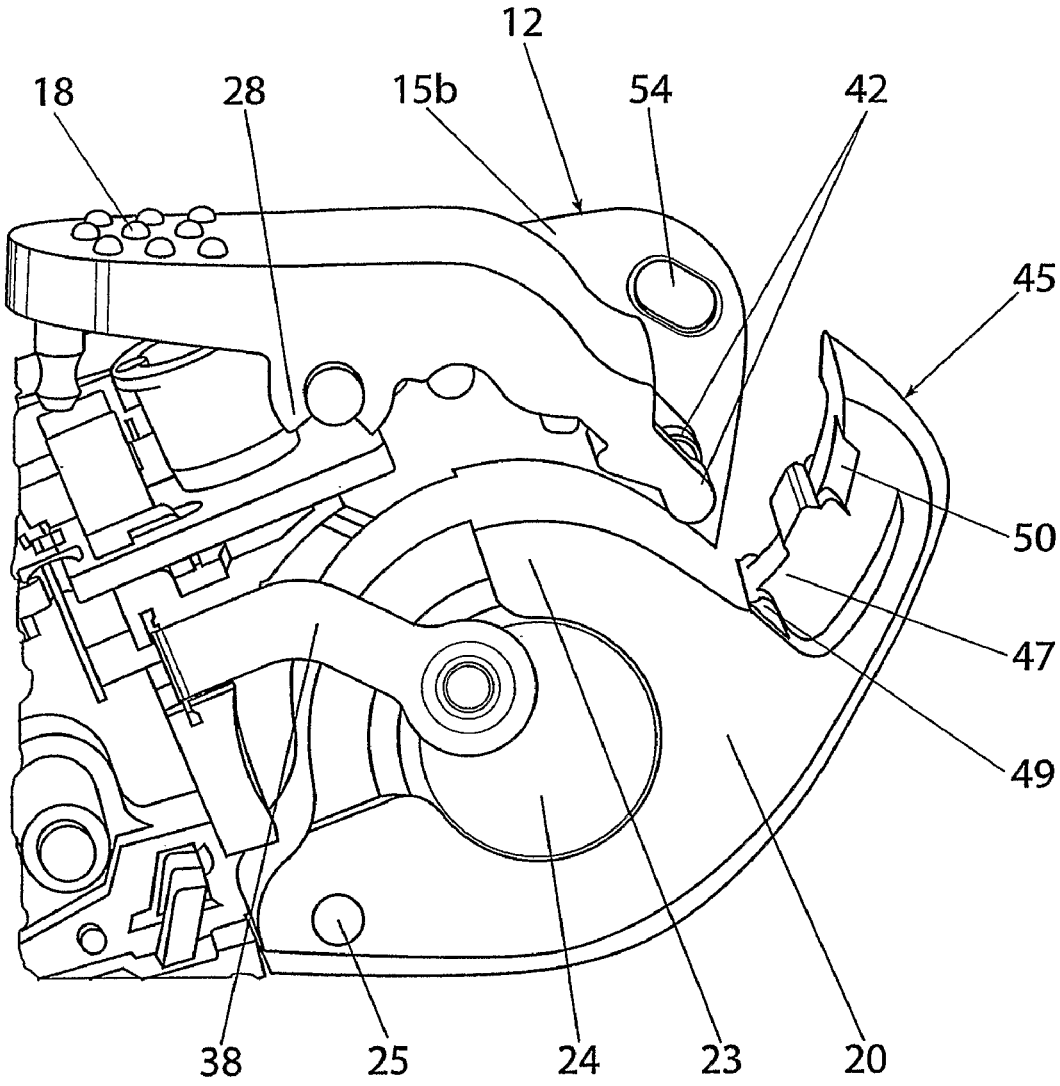
FIG. 4 is a view of yet another section of the hearing aid device shown in FIG. 1 with part of the housing removed so as to show the internal parts of the device.

Corresponding ends of the grooves 40 include openings 47 through which the corresponding pins 42 of the cover 18 can pass into and out of the grooves 40. For example, the on/off cover 18 can be disconnected from the battery compartment door 20 by arranging the on/off cover in the off position, as shown in FIG. 6, and then drawing the pins 42 of the cover 18 through openings 47, as shown in FIG. 4. In doing so, the battery compartment door 20 is free to rotate about the axle 25 away from the housing 12 towards an open position. The openings 47 of the grooves 40 are each narrowed by respective shoulders 49 which reduce the ease by which the pins 42 of the cover 18 can pass there through. The shoulders 49 prevent the battery compartment door 20 from freely rotating about the axle 25 when the cover 18 is arranged in the off position. With a little effort a person can force the pins 42 of the cover 18 through the openings 47 and thereby open the battery door 20.

The on/off cover 18 is coupled to the door 20 by locating the pins 42 in the grooves 40 by forcing the pins 42 through respective openings 47 in the manner shown in FIGS. 4 and 6. The diameter of the two openings 47 of the groove 40 is slightly narrower than the diameter of the pins 42 such that the pins 42 can only be fitted into and disengaged from the groove 40 if a suitable force is used. The on/off cover 18 and the door 20 are decoupled by arranging the on/off cover 18 in the off position and then forcing the pins 42 through the openings 47.

The following steps are performed to remove the battery from the device 10:

1. Arrange the on/off cover 18 in the off position;
2. Decouple the on/off cover 18 and the housing in the described manner;
3. Pivot the door 20 away from the housing 12; and
4. Remove the battery 24.

The above steps are performed in reverse order to locate the battery within the housing for electrical connection to the circuit 22.

Figure 10:
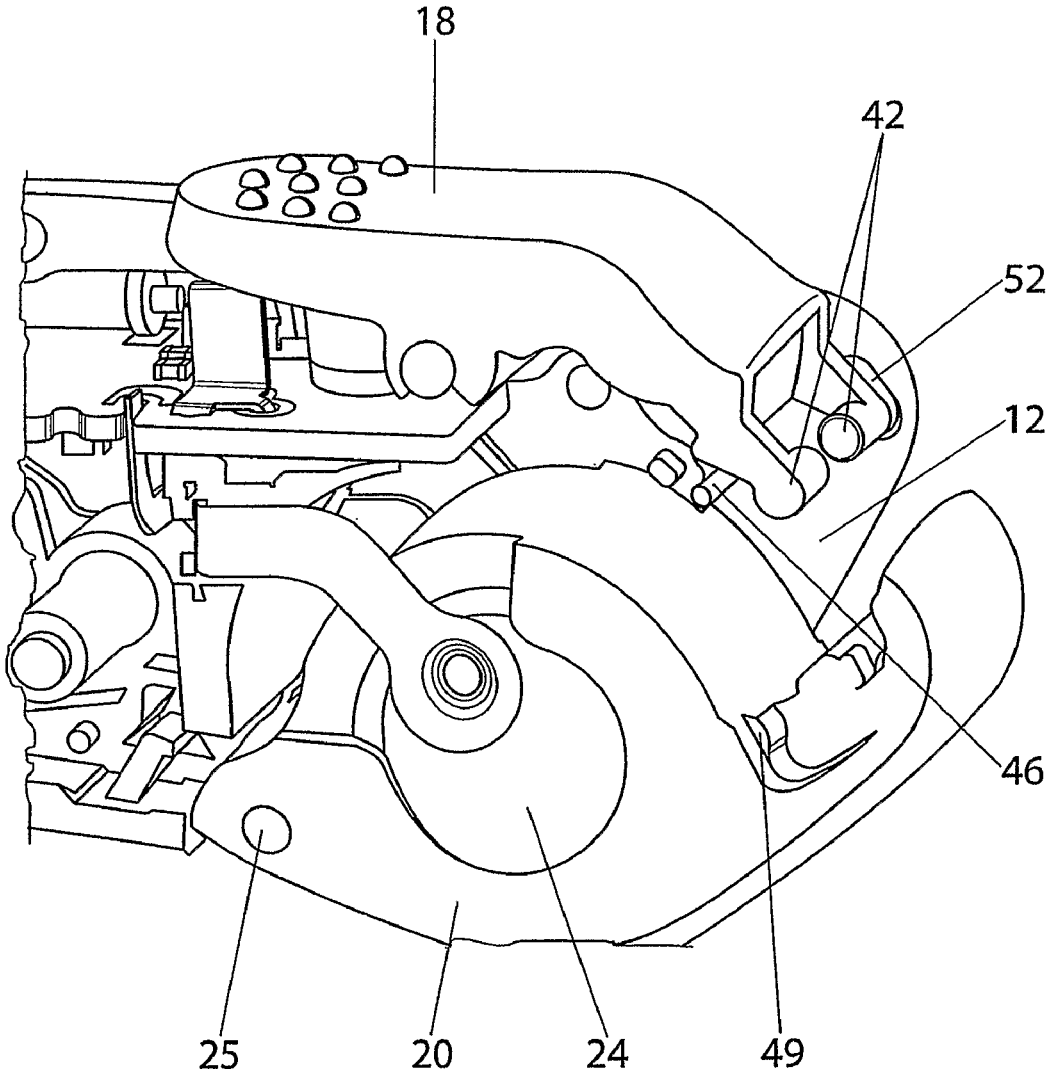
FIG. 10 is a view of another section of the hearing aid device shown in FIG. 1 with part of the housing removed so as to show the internal parts of the device.
Figure 11:
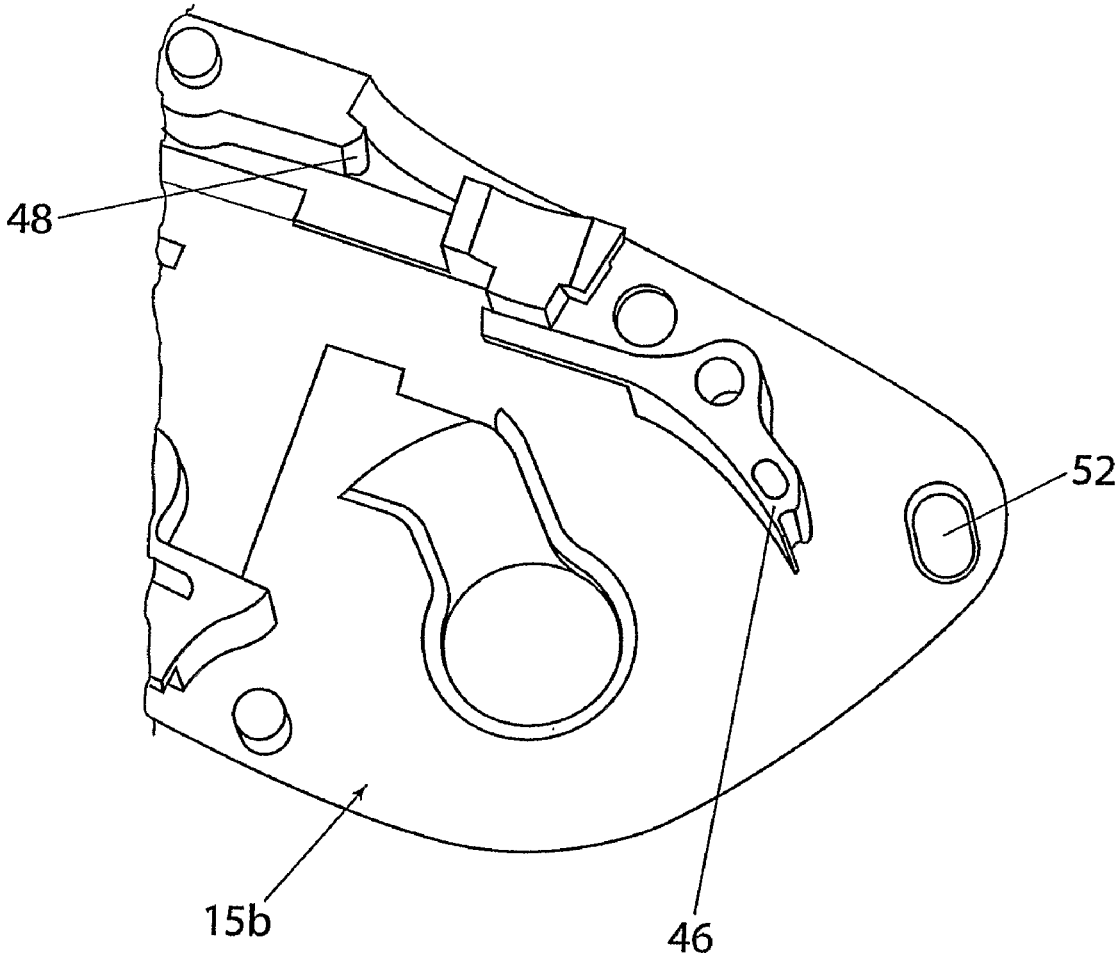
FIG. 11 is a view of an internal side of a part of the hearing aid shown in FIG. 1.

The inner side of the one of each one of the shells 15*a*,15*b* of the housing 12 includes a stopper 46 in the form of a protruding ledge, shown in FIGS. 10 and 11. The stopper 46 is arranged to limit rotation of the on/off cover 18 in one direction. The housing 12 includes a further stopper 48 is arranged to limit rotation of the on/off cover 18 in the opposite direction.

Figure 12:
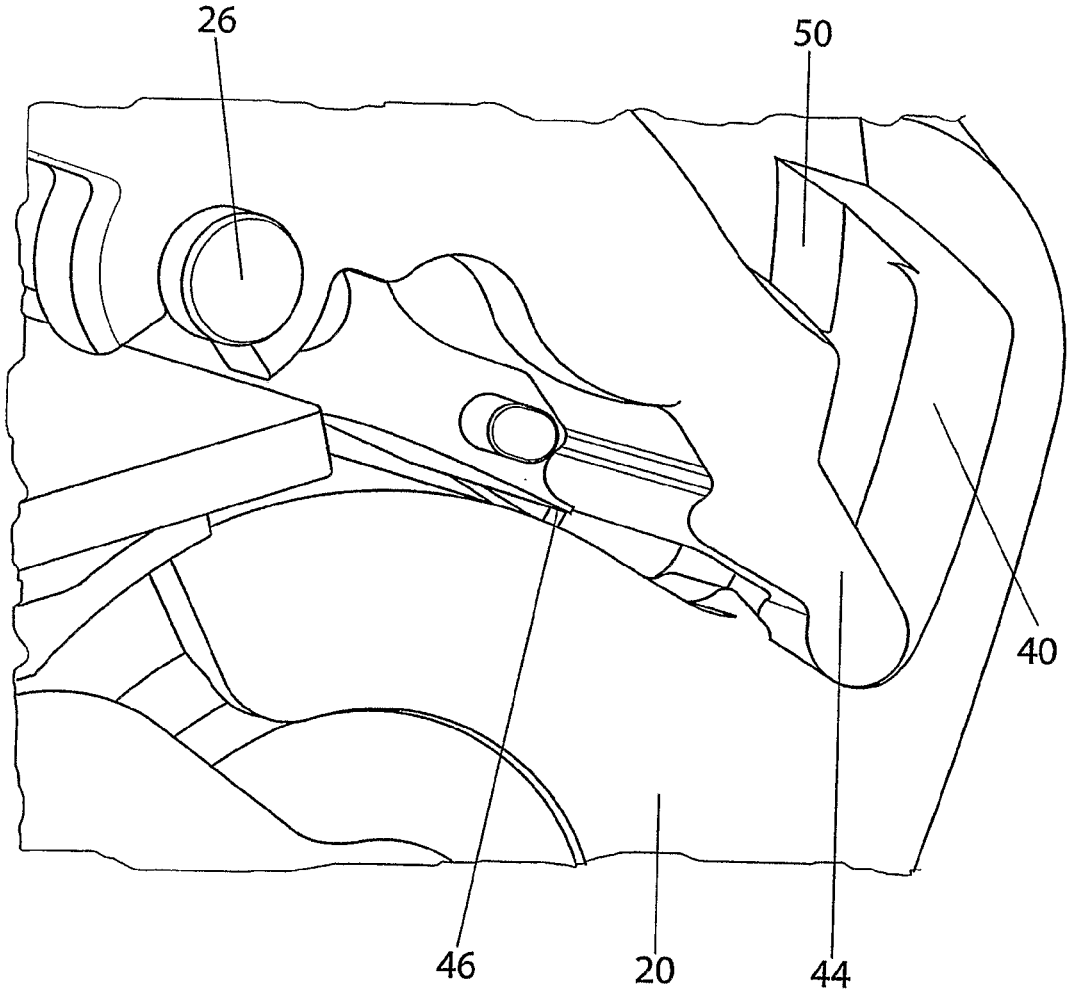
FIG. 12 is a view of yet another section of the hearing aid device shown in FIG. 1 with part of the housing removed so as to show the internal parts of the device.

The locking section 45 further includes chamfer surfaces 50, as shown in FIG. 12, over which the pins 42 may also be located in the grooves 40. The chamfer surfaces 50 are located at an opposite ends of the grooves to the above described openings 47. The pins are located in the grooves 40 by arranging the on/off cover 18 in the closed position and forcing the pins 42 into the grooves 40 through the chamfer section 50. The chamfer surfaces 50 are tapered and thus help to guide the pins 42 into position. The internal side of both shells 15*a*,15*b* of the housing 12 are provided with respective recesses 52 to allow the pins 42 to flex outwards when they are fitted into the groove 40 in such a situation.

Figure 13:
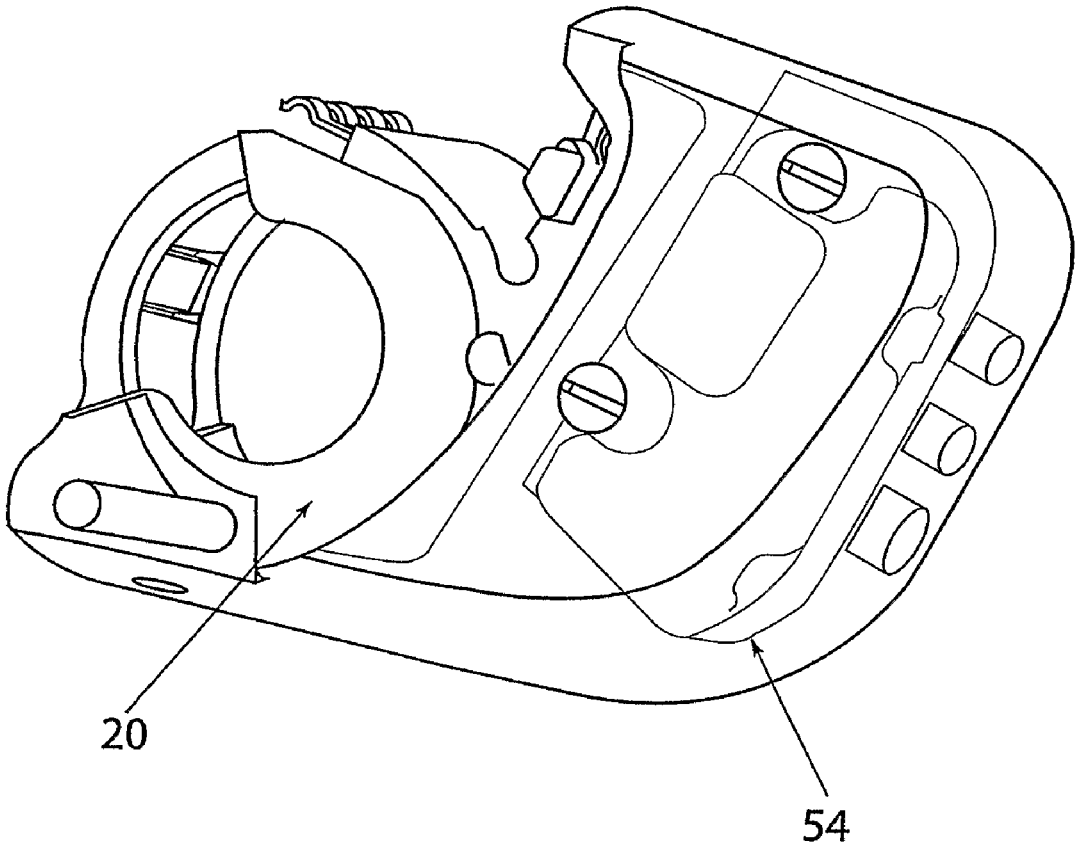
FIG. 13 is a perspective view of the battery compartment of the hearing aid integrated with an audio device.

The battery compartment door 20 can be replaced with one that integrates an audio device 54 suitable for say FM frequency reception, as shown in FIG. 13. The on/off cover 18 would still be compatible with the replacement battery compartment door 20.

The various components are injection moulded from plastic material such as Acrylonitrile Butadiene Styrene (ABS).

Figure 14:
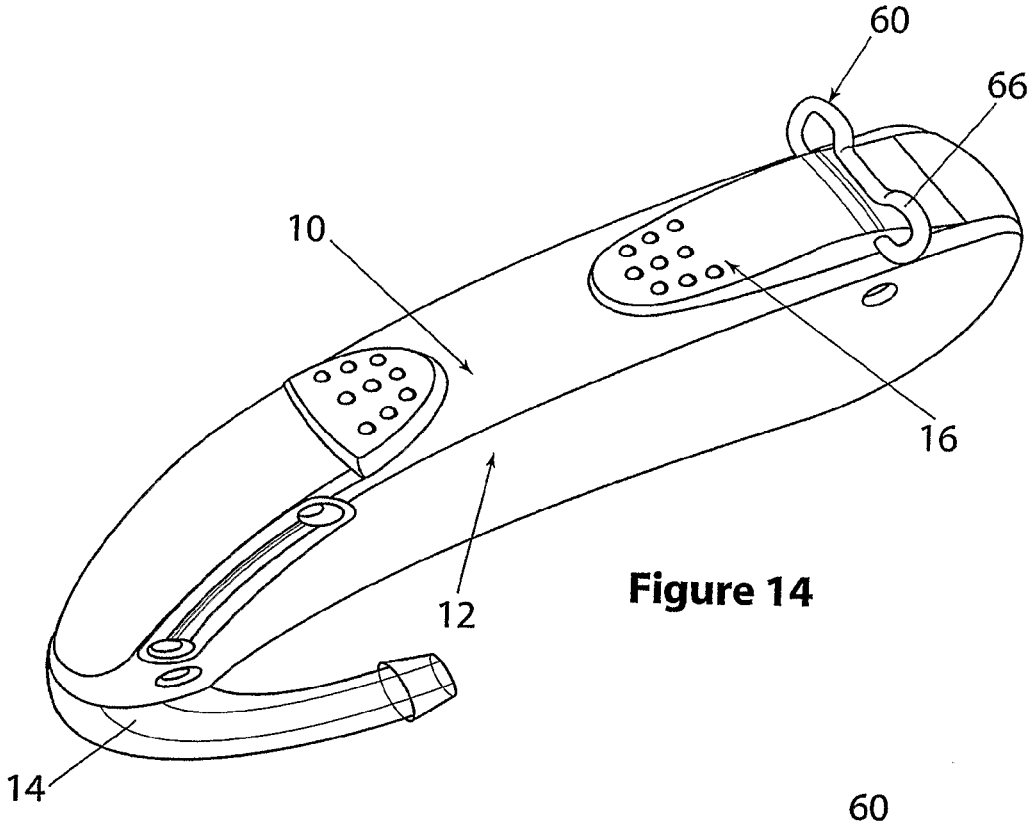
FIG. 14 is a perspective view of a hearing aid device in accordance with a preferred embodiment of the invention arranged in a condition of use.
Figure 15:
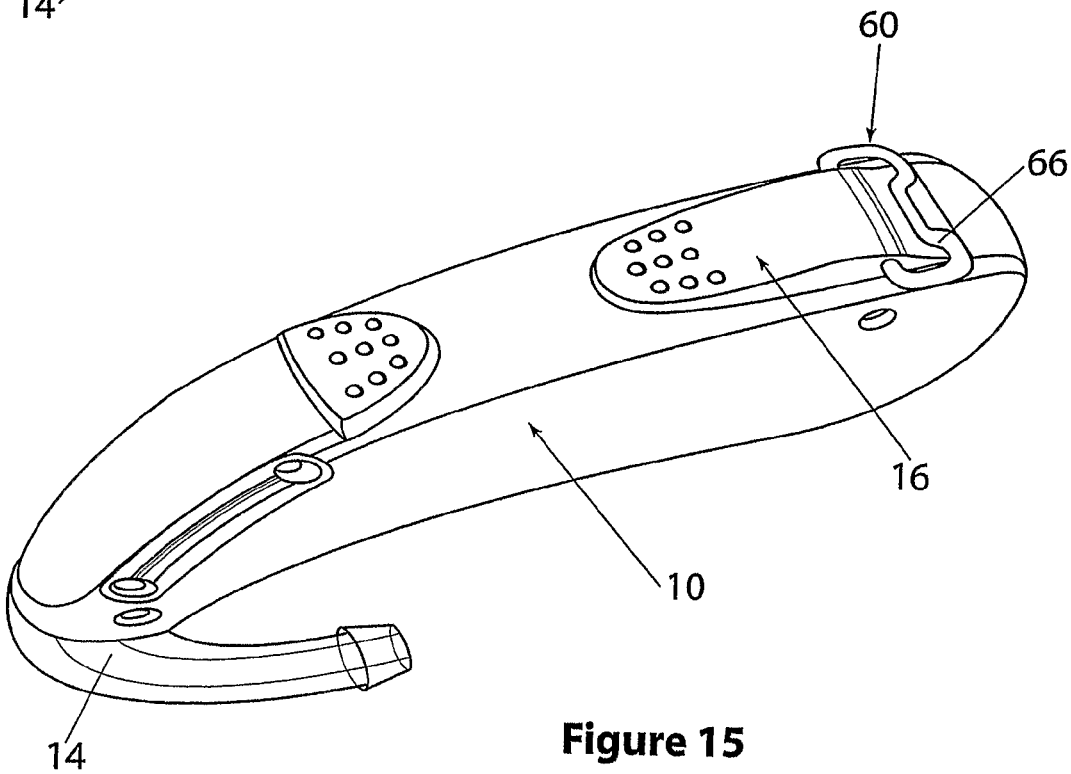
FIG. 15 is a perspective view of a hearing aid device shown in FIG. 13 arranged in another condition of use.

The on/off cover 18 shown in FIGS. 14 and 15 includes a lock 60 for preventing the hearing aid device from being inadvertently switched off. The lock functions by preventing the on/off cover 18 from rotating about the axle 26 towards the off position. The lock 60 is hereafter described with reference to the hearing aid device 10. However, it would be understood by those skilled in the relevant art that the lock 60 is applicable to other hearing aid devices, such as the device disclosed in U.S. Pat. No. 4,831,655.

Figure 16:
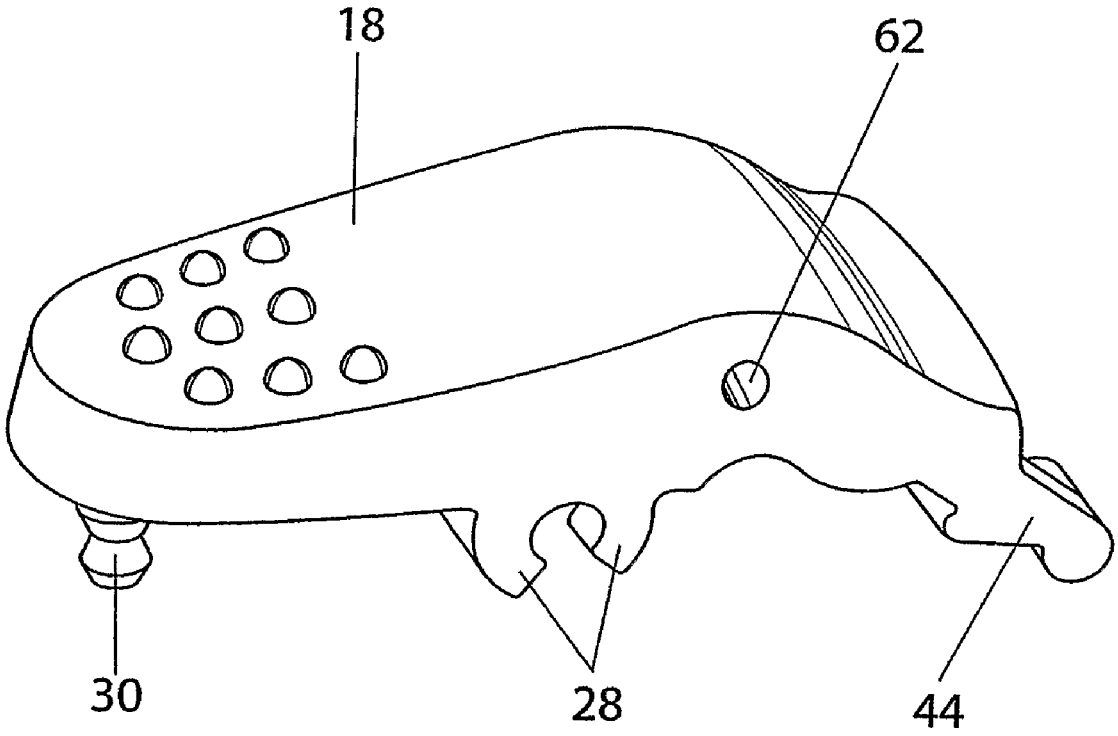
FIG. 16 is a perspective view of a part hearing aid device shown in FIG. 14.

The on/off cover 18 includes first and second recessed sections 62 disposed on opposite side walls for engagement with the lock 60, as shown in FIG. 16 (only one of the side walls is shown in the drawings). The recessed sections 62 are aligned parallel to the axis of rotation of the on/off cover 18 and are located between said axis of rotation and the end of the cover 18 that is couplable to the battery compartment door 20. The recessed sections 62 are positioned so that they are externally accessible when the cover 18 is in the on position and are adjacent the internal walls of the housing 12 when the cover 18 is arranged in the off position.

When fitted to the cover 18, the lock 60 extends outwardly from each recessed section 62. As the cover 18 is moved from the on position towards the off position, the lock engages an upper surface of the walls of the housing 12 and thereby prevents the cover 18 from further rotating towards the off position. The lock 60 prevents the hearing aid device 10 from being turned off. In doing so, the lock 60 also prevents the battery 24 from being removed from the device 10.

Figure 17:
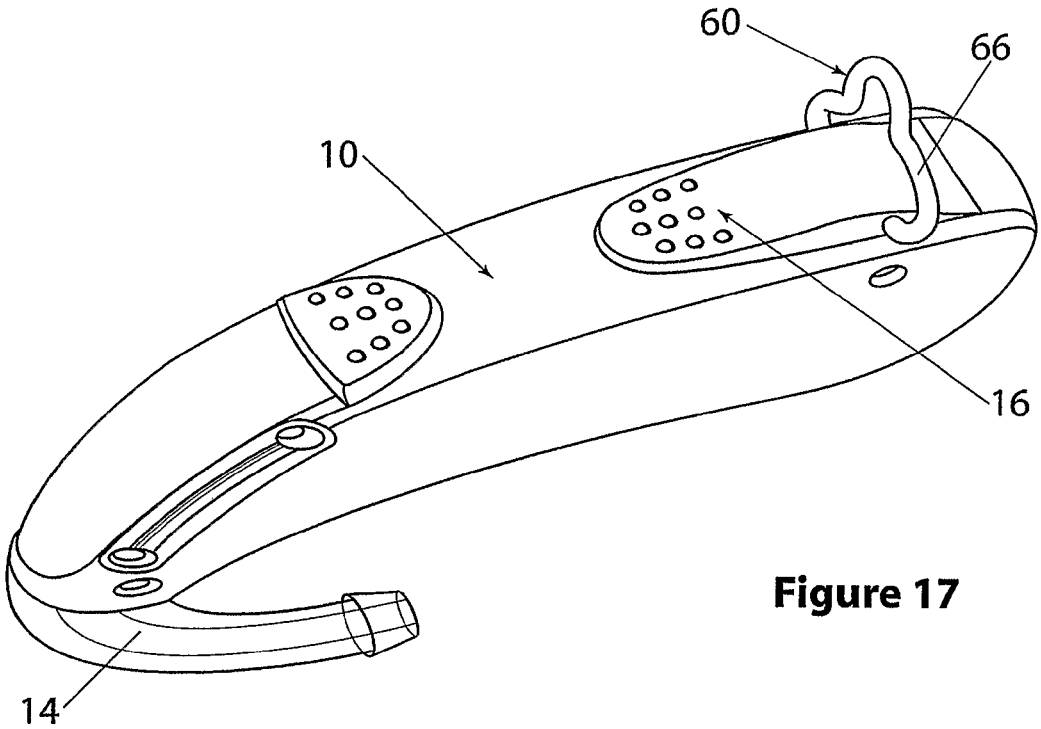
FIG. 17 is a perspective view of a hearing aid device in accordance with a preferred embodiment of the invention arranged in a condition of use.
Figure 18:
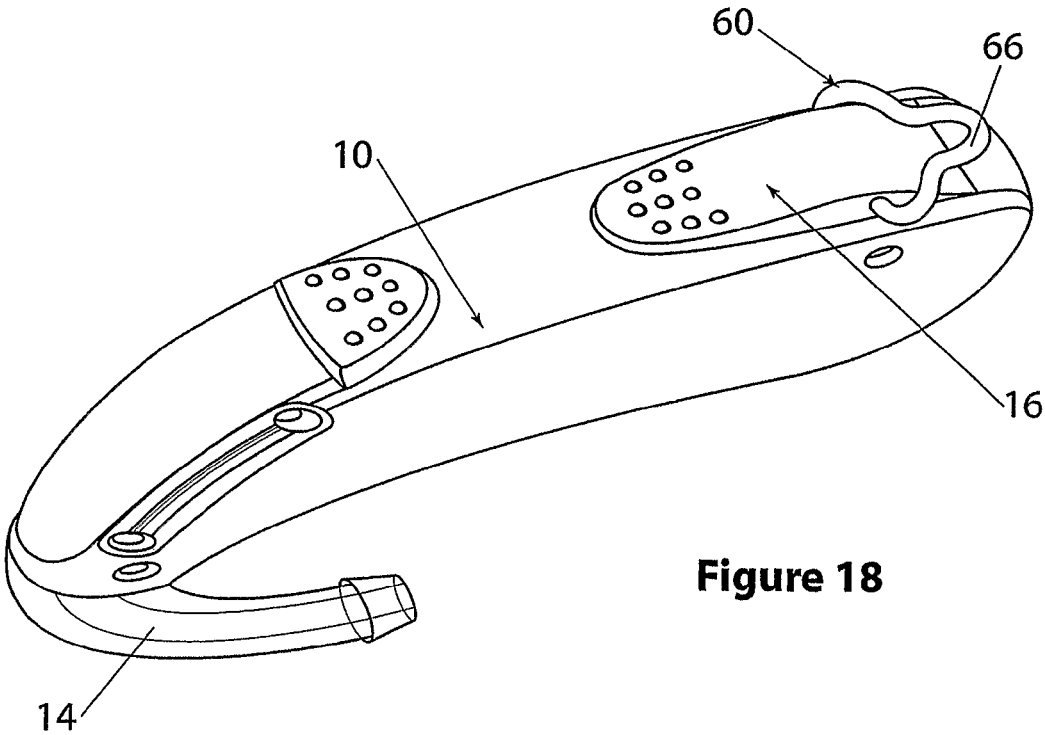
FIG. 18 is a perspective view of a hearing aid device shown in FIG. 17 arranged in another condition of use.
Figure 19:
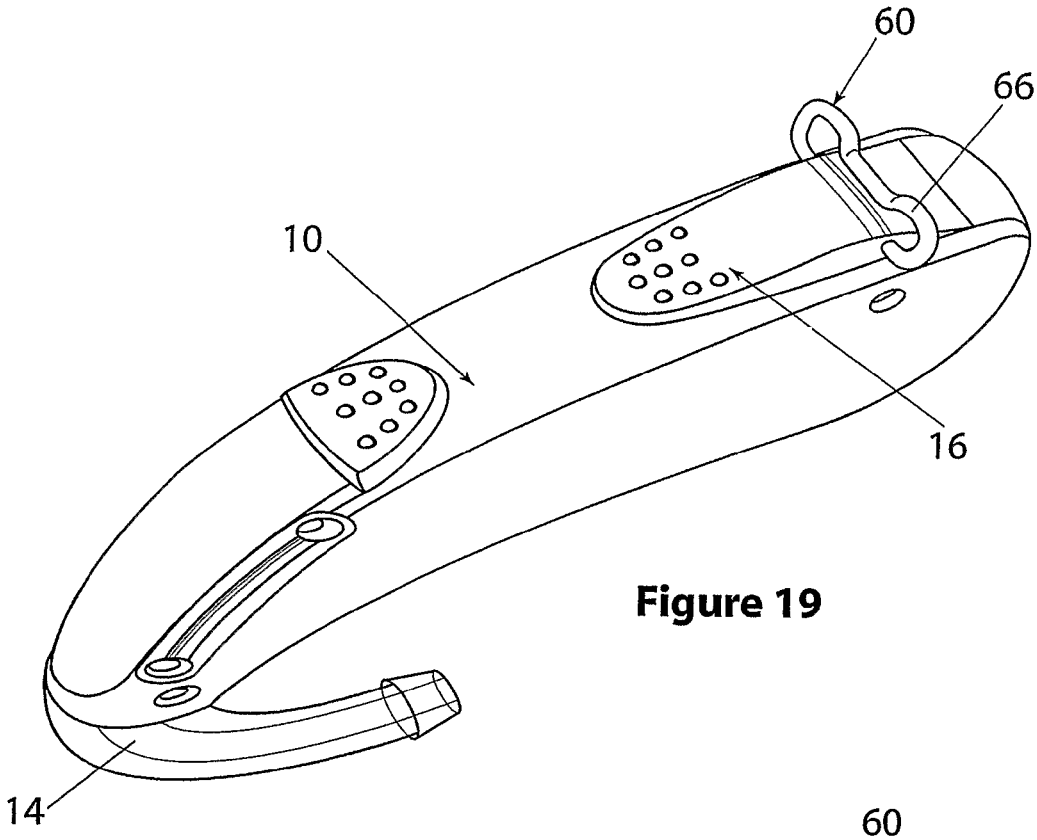
FIG. 19 is a perspective view of a hearing aid device in accordance with a preferred embodiment of the invention arranged in a condition of use.
Figure 20:
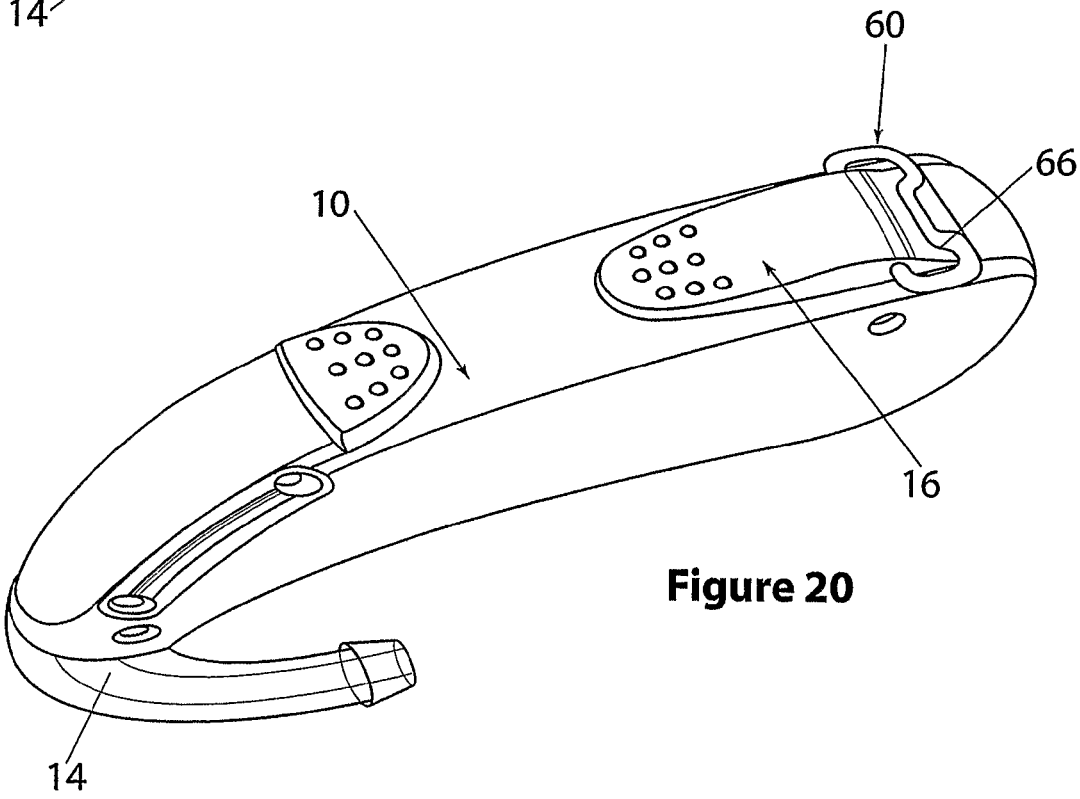
FIG. 20 is a perspective view of a hearing aid device shown in FIG. 19 arranged in another condition of use.
Figure 21:
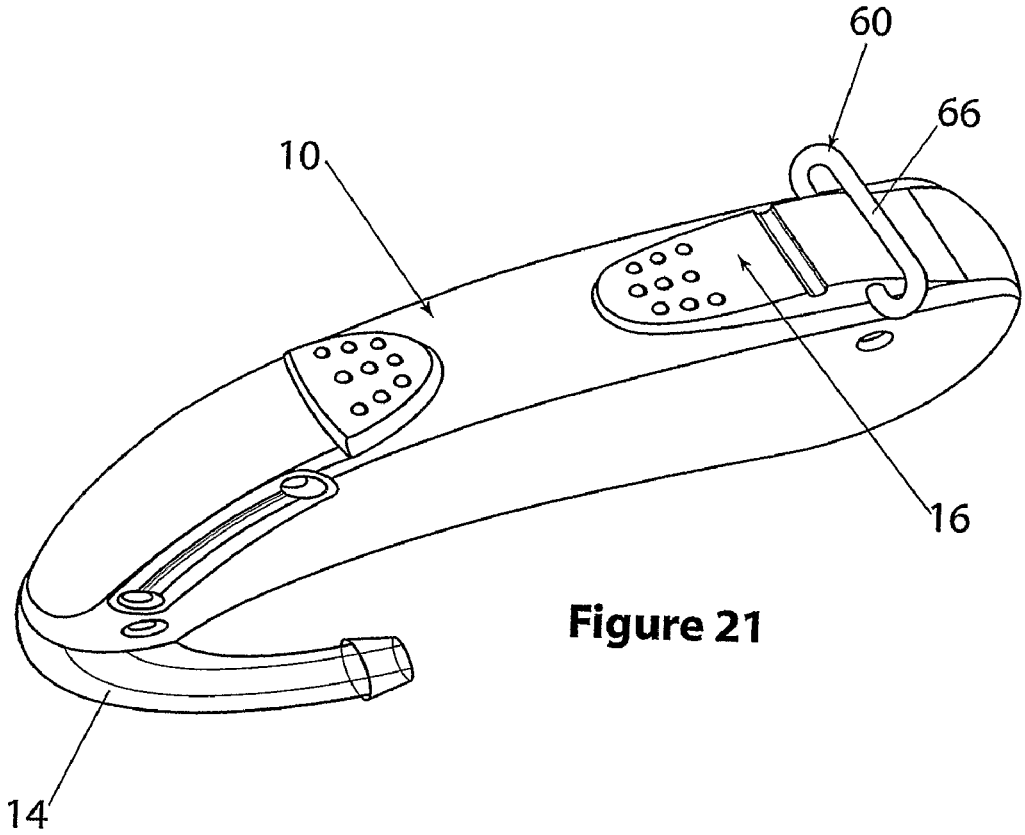
FIG. 21 is a perspective view of a hearing aid device in accordance with a preferred embodiment of the invention arranged in a condition of use.
Figure 22:
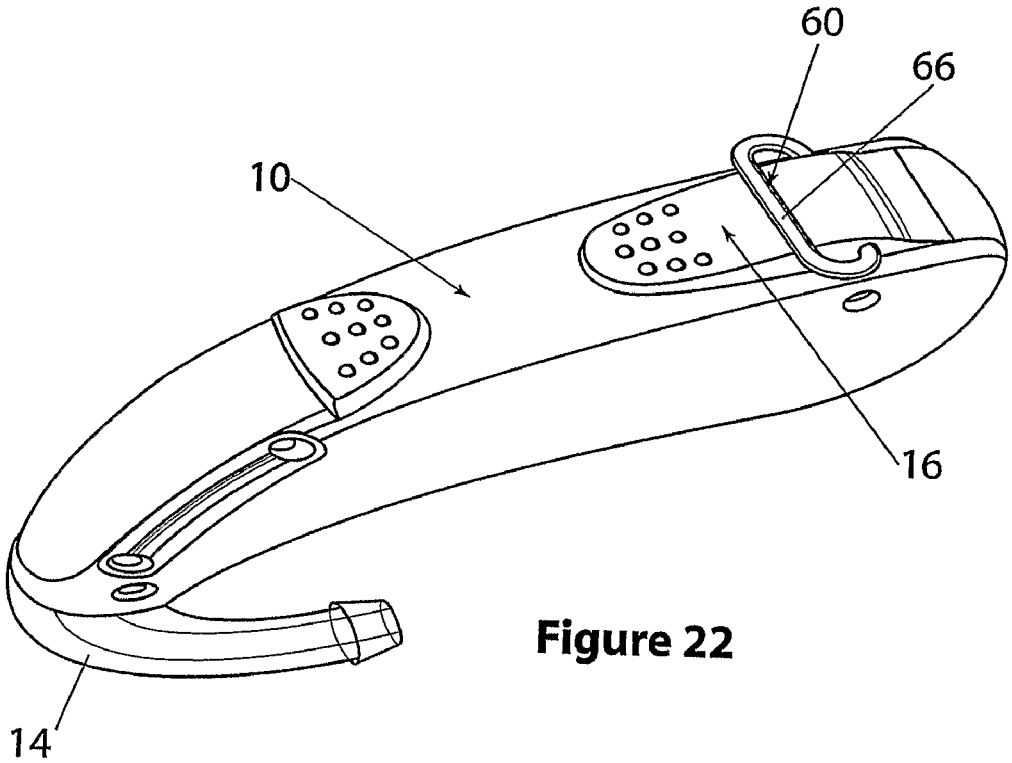
FIG. 22 is a perspective view of a hearing aid device shown in FIG. 21 arranged in another condition of use.

The lock 60 is preferably an open ended ring 66 that can be resiliently expanded to bridge the recessed sections 62 of the cover 18, as shown in FIGS. 17 to 18. The ring 66 resiliently bears against the recessed sections 62 of the cover 18 and is thereby held in position. The ring 66 may take any one of a number of different shapes and configurations that facilitate the prevention of the cover 18 rotating from the on position towards the off position. Some other examples of preferred embodiments of the ring 66 are shown in FIGS. 19 to 22.

Figure 23:
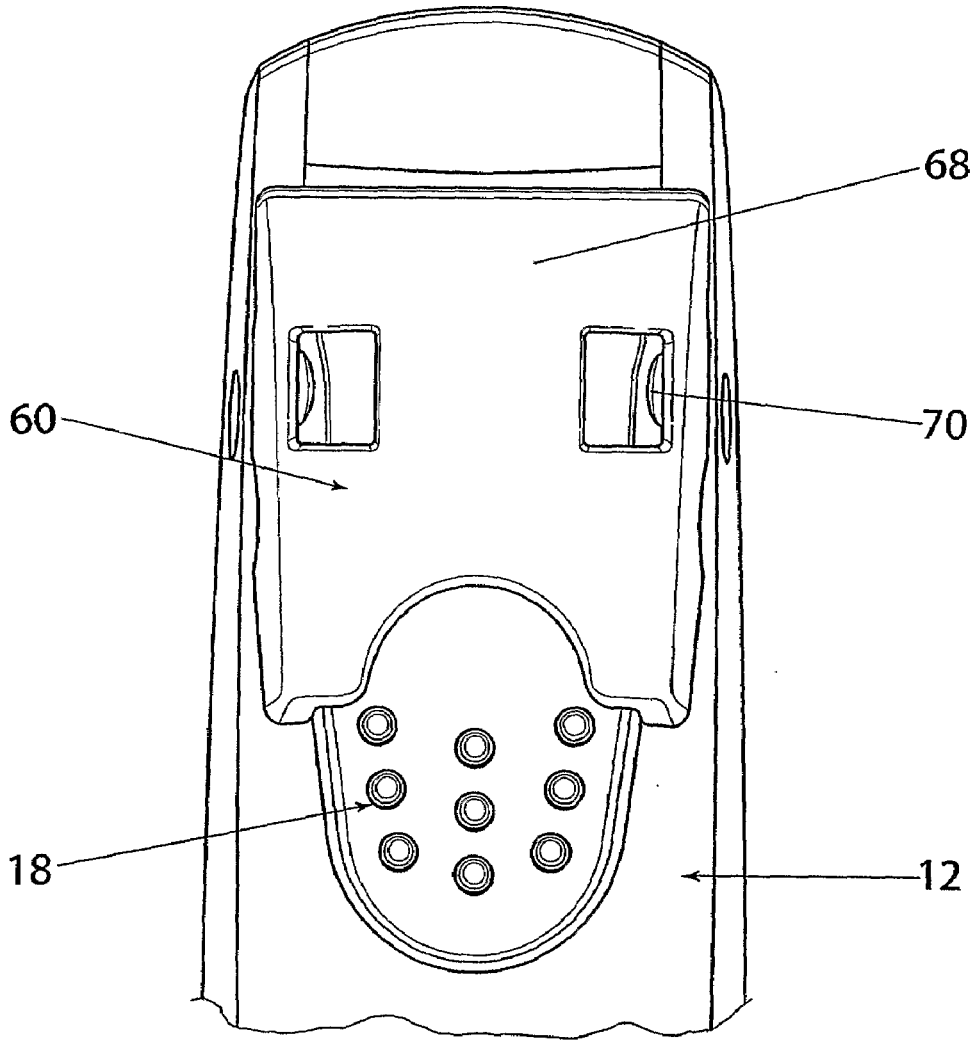
FIG. 23 is a plan view of lock connected to a hearing aid device, in accordance with a preferred embodiment of the invention.
Figure 24:
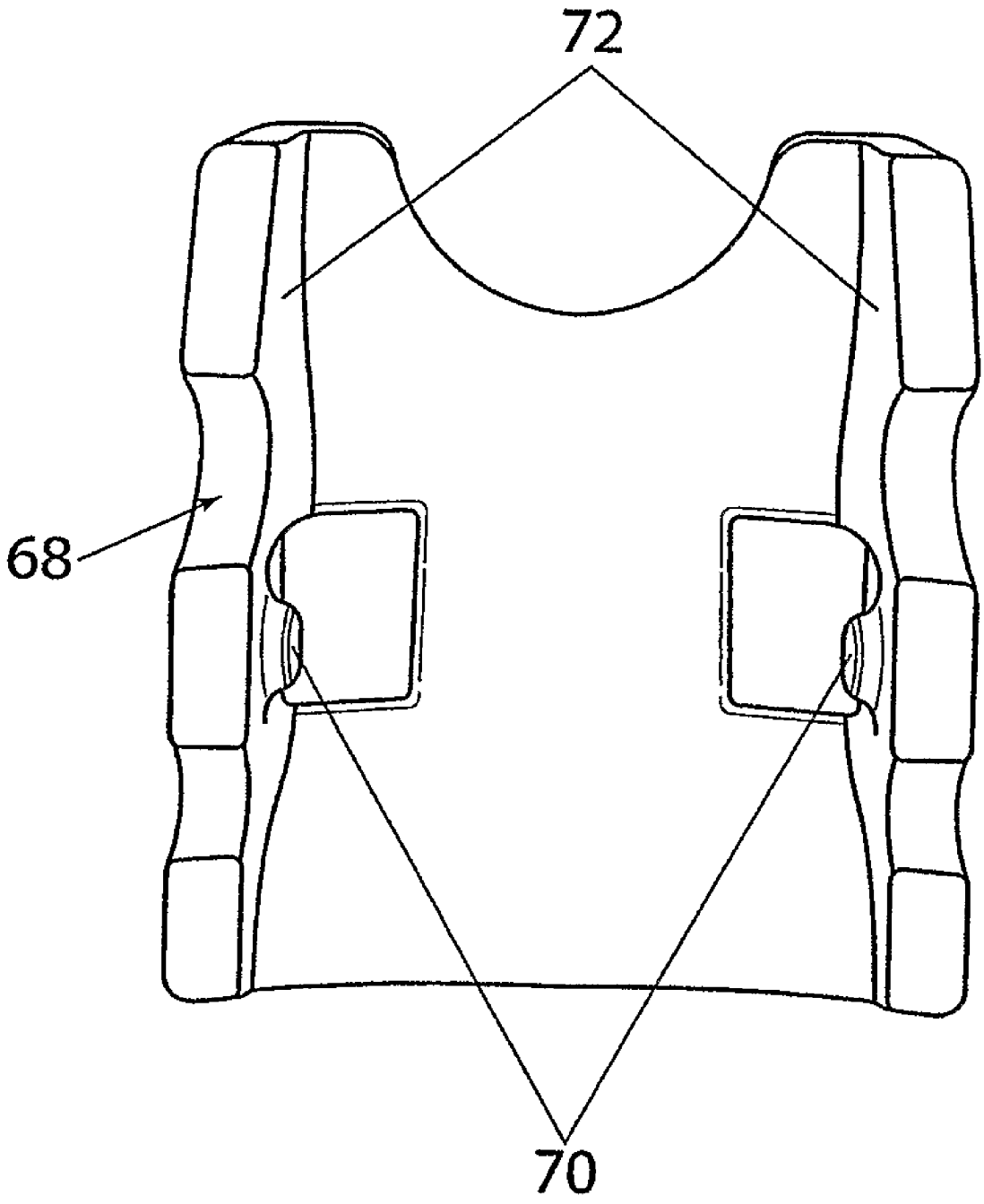
FIG. 24 is a bottom view of the lock shown in FIG. 23.
Figure 25:
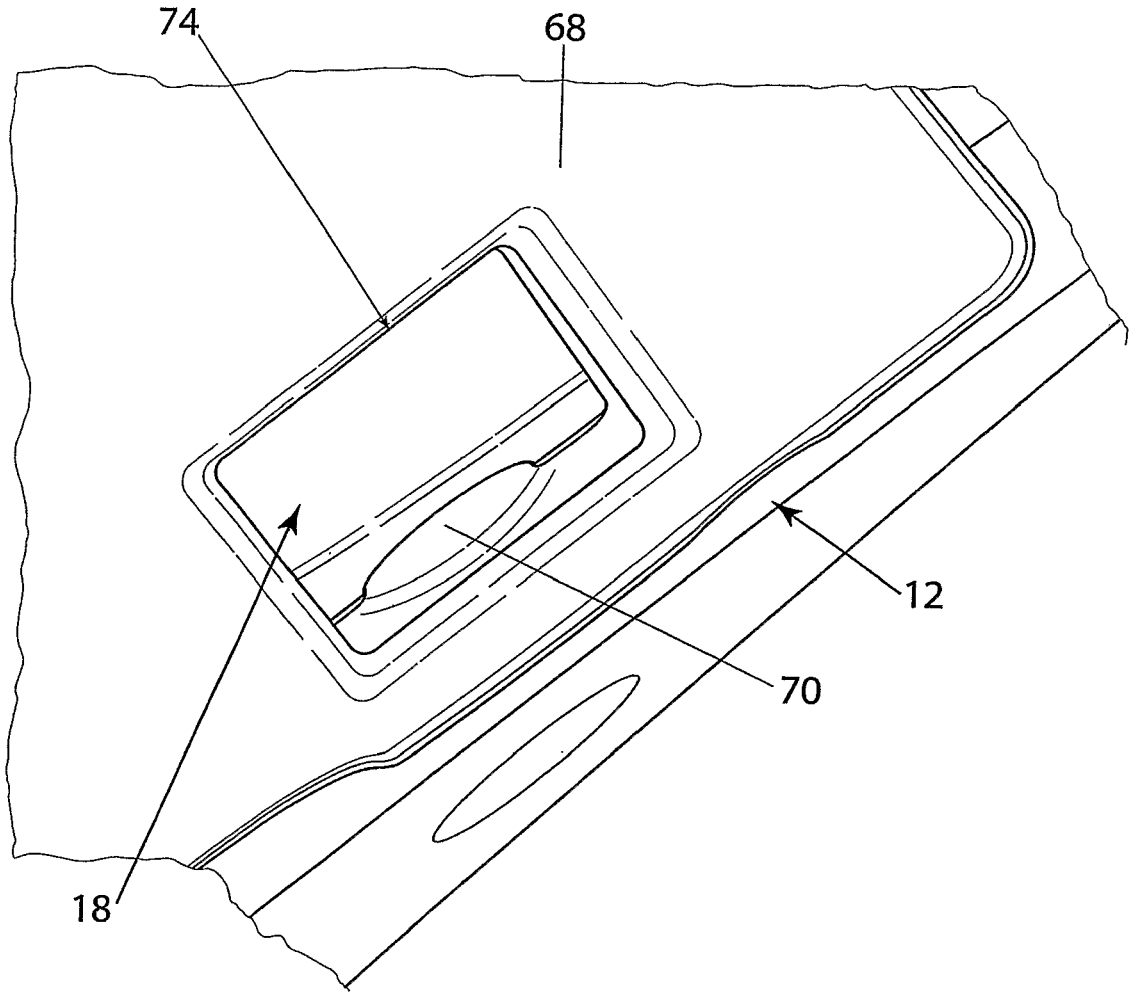
FIG. 25 is a view of a part of the lock shown in FIG. 24.
Figure 26:
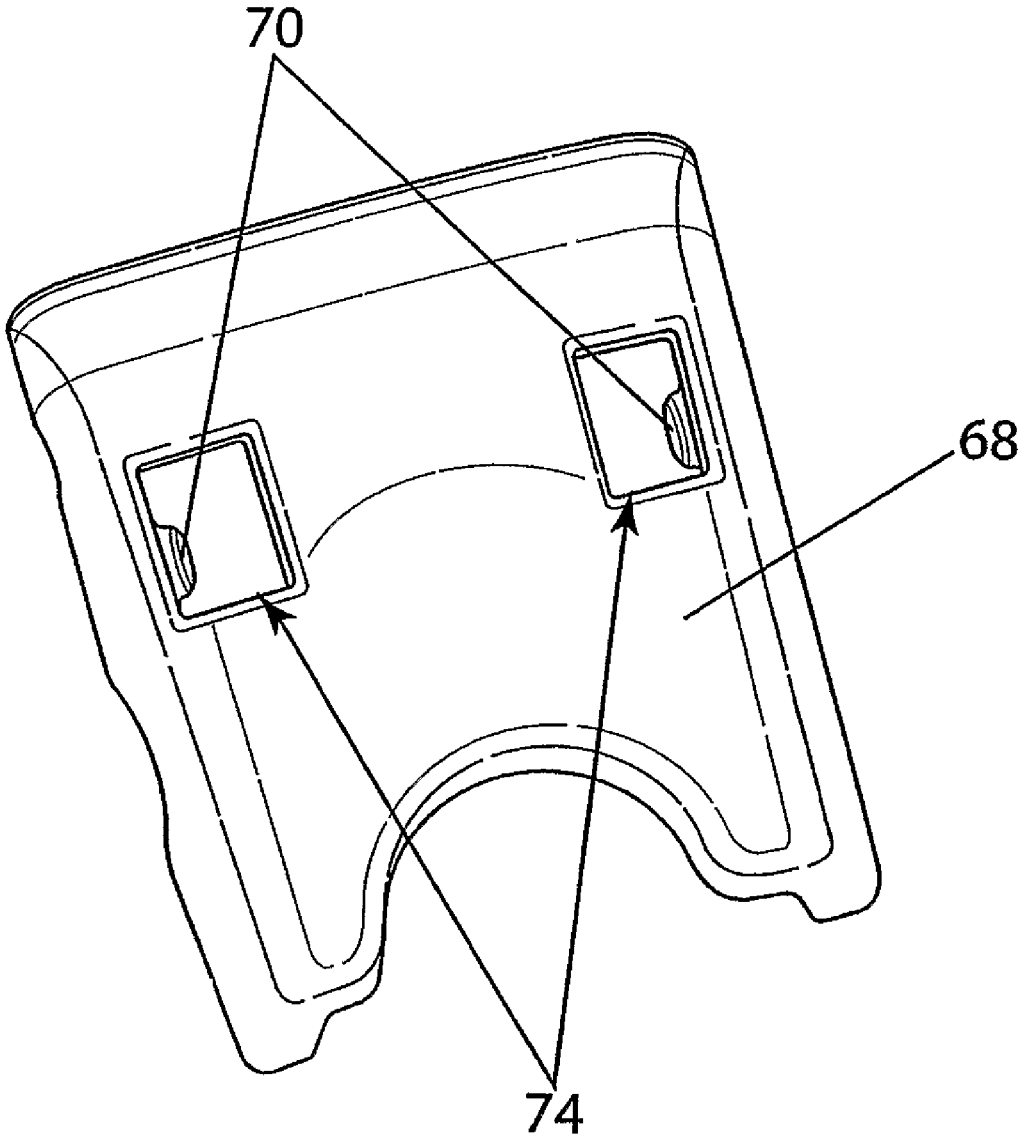
FIG. 26 is a perspective view of the lock shown in FIG. 23.

Alternatively, the lock 60 is a cap 68, as shown in FIG. 24, that is shaped to fit over the on/off cover 18, in the manner shown in FIG. 23, to thereby prevent the cover 18 from being arranged in the off position. The cap 68 includes two inwardly directed protrusions 70 that project from respective opposed side walls 72 of the cap 68, as shown in FIGS. 24 to 26. The protrusions 70 are positioned to extend into the recessed sections 62 of the cover 18 and, when so fitted, prevent the cover 18 from being arranged in the off position.

The cap 68 is made of any suitable material that is flexible, resilient so that the side walls 72 can bend resiliently as the cap 68 is being fitted to the cover 18. The cap 68 is fitted to the cover 18 by arranging the cap 68 over the cover 18 and aligning protrusions 70 along side the corresponding recessed sections 62 by locating the recessed sections 62 through the open viewing windows 74. The cap 68 is pressed into position so that the protrusions 70 extend into the recessed sections 62 of the cover 18. The cap 68 can be removed by bending one or more of the walls 72 away from the cover 18 to release the protrusions 70 from their respective recesses 62. Preferably, the cap 68 can be removed from the cover by hand.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

Claims defining the invention are as follows:

1. A hearing aid device, comprising:

a switch that opens and closes an electric circuit of the hearing aid device;

a battery locating device that selectively locates a battery within the hearing aid device for electrical communication with the electric circuit and prevents removing the battery from the electrical communication when the switch closes the electric circuit, wherein the switch is separate from the battery locating device, the switch comprising a conductive terminal that is independently operable for opening and closing the electrical circuit without disconnecting the battery from the electrical circuit; and a locking device, the locking device being accessible to a user of the device so as to be brought into a condition in which it prevents the switch to be operated to open the electric circuit.

2. The hearing aid device claimed in claim 1, wherein the battery locating device permits an access to the battery for removing the battery from the hearing aid device when the switch opens the electric circuit.

3. The hearing aid device claimed in claim 1, wherein the battery locating device moves the battery with respect the electric circuit to connect and isolate the battery to and from the electric circuit.

4. The hearing aid device claimed in claim 1, wherein the switch is mechanically coupled to the battery locating device.

5. The hearing aid device claimed in claim 1, wherein the switch pivots about a body portion of the hearing aid device to open and close the electric circuit.

6. The hearing aid device claimed in claim 1, wherein the switch is decouplable from the battery locating device when the switch opens the electric circuit.

7. The hearing aid device claimed in claim 6, wherein the switch comprises a first pin and a second pin that extend into corresponding grooves of the battery locating device and the first and the second pins slidably engage the grooves in accordance with a movement of the switch.

8. The hearing aid device claimed in claim 7, wherein the grooves comprise openings located at a common end that facilitate insertion and removal of the first and the second pins into and from the grooves.

9. The hearing aid device claimed in claim 1, wherein the battery locating device is a battery compartment door.

10. The hearing aid device claimed in claim 1, wherein the locking device prevents rotating the switch when the switch pivots to open the electric circuit.

11. A hearing aid switch for a hearing aid device, comprising:

an activation switch that opens and closes an electric circuit of the hearing aid device;

a battery locating device that selectively locates a battery within the hearing aid device for electrical communication with the electric circuit and prevents removing the battery from the electrical communication when the activation switch closes the electric circuit, wherein the activation switch is separate from the battery locating device, the activation switch comprising a conductive terminal that is independently operable for opening and closing the electrical circuit without disconnecting the battery from the electrical circuit; and a locking device, the locking device being accessible to a user of the device so as to be brought into a condition in which it prevents the activation switch to be operated to open the electric circuit.

12. The hearing aid switch as claimed in claim 11, wherein the battery locating device is a battery compartment door.

* * * * *